US005947622A

United States Patent [19]

Akyildiz et al.

[11] Patent Number: 5,947,622

[45] Date of Patent: Sep. 7, 1999

[54] CONTAINER FOR FAST DRYING LIQUIDS

[76] Inventors: Saban Akyildiz; Carmela Nitti Akyildiz, both of 309 Mamaroneck Ave., White Plains, N.Y. 10606

[21] Appl. No.: 09/026,909

[22] Filed: Feb. 20, 1998

Related U.S. Application Data

[60] Provisional application No. 60/055,962, Aug. 18, 1997.

[51] Int. Cl.[6] ..... A46B 11/00

[52] U.S. Cl. ..... 401/129; 215/296; 401/126

[58] Field of Search ..... 401/126, 129; 215/296, 305, 354; 220/326

[56] References Cited

U.S. PATENT DOCUMENTS

| | | | |
|---|---|---|---|
| 562,134 | 6/1896 | Haner | 401/126 |
| 1,326,885 | 12/1919 | Wales . | |
| 1,643,009 | 9/1927 | Gouffer . | |
| 1,938,376 | 12/1933 | Dietrichs . | |
| 2,446,661 | 8/1948 | Murdock | 215/354 |
| 2,594,467 | 4/1952 | Lynch, Jr. et al. | 220/326 |
| 2,990,076 | 6/1961 | Stull | 401/129 |
| 3,341,884 | 9/1967 | Pryor . | |
| 4,177,930 | 12/1979 | Crisci . | |
| 4,313,686 | 2/1982 | Proffer | 401/129 |
| 4,589,567 | 5/1986 | Pircher | 220/326 |
| 4,755,356 | 7/1988 | Robbins et al. | 422/102 |
| 4,797,244 | 1/1989 | Sauer | 264/266 |
| 4,922,934 | 5/1990 | Gatti | 401/129 |
| 5,390,811 | 2/1995 | Ogino et al. | 220/326 |

FOREIGN PATENT DOCUMENTS

| | | | |
|---|---|---|---|
| 390778 | 12/1922 | Germany | 401/129 |
| 3408 | 7/1919 | Niger | 215/305 |

*Primary Examiner*—Charles R. Eloshway
*Attorney, Agent, or Firm*—Gottlieb, Rackman & Reisman, P.C.

[57] ABSTRACT

A container closure, having a fluid applicator such as a brush or dropper, that fits over the container secured by a spring clip. The neck of the bottle ends in a seal seated on oil based paper, which is itself seated on a rubber or plastic ring. A slight bulge just below the neck acts as a catch. In use the cap has levers with protrusions that slide down over the bulge and hook into place, under the bulge. The cap opens only when pressed on both sides at the same time; otherwise the bottom of the spring clip is held in place by the bulge. By pressing both sides at once, the cap can slip over the bulge and off the bottle. The double press spring clip cap has the additional value of being child proof. The liner of the bottle, (or possibly the bottle itself if desired) is in the shape of the letter V. The V shape means that when the bottle is upright, the fluid will collect in the bottom of the V and be accessible and usable until the last drop is consumed.

7 Claims, 2 Drawing Sheets

CONTAINER FOR FAST DRYING LIQUIDS

This application claims benefits of U.S. Provisional Appl. No. 60/055,962, filed Aug. 18, 1997.

TECHNICAL FIELD

The present invention relates to containers and, in particular, to containers for fast drying liquids. More specifically, the invention is directed towards an improvement of the container's product utilization efficiency and the container's closure.

BACKGROUND OF THE INVENTION

This invention relates generally to containers and, more particularly, is directed to containers for fast drying liquids such as nail polish and glue.

Reusable containers for viscous fluids are limited by the tendency of fluids such as women's nail polish and glue to dry up, become gummy and adhere to the lids of the containers. This makes opening the containers either difficult or impossible. These viscous fluids also tend to dry up at the bottom of the container once the fluid level falls and only a thin layer covers the bottom.

Containers for fast drying fluids having tapered bottoms are generally unknown. The closest prior art known to the inventors are locking microcentrifuge tubes. See U.S. Pat. No. 4,755,356, issued Jul. 5, 1988. These tubes are constructed with a taper so as to facilitate the insertion of the tubes into a centrifuge holder and apparently to facilitate the removal of the contents of the tube by the use of a pipette. They do not use a structure attached to their cover to remove their contents. Further, these tubes are not concerned with fast drying fluids accumulating at their top through multiple use, since the centrifuge causes the liquids to be spun to the bottom of the tube. On the contrary the invention of the '356 patent is intended to provide a more secure seal to prevent the accidental loosening of the cover, which is assumed to be easily removable.

U.S. Pat. No. 1,938,376 disclosed a paint brush holder with a tapered bottom. This invention is not a covered container. Its tapered shape served the purpose of maintaining the shape of the brush, and not to extract more paint from a container.

U.S. Pat. No. 1,326,885 disclosed container closures which were deformable to facilitate removal. They did not have the lever mechanism of the present invention and required a loose fit to allow the lid to deform inwardly in certain parts of the circumference of the lid.

U.S. Pat. No. 4,177,930 disclosed a large container, like a garbage can, with a deformable lid. Here the lid appears to have snapped onto the container and was removed by lifting upwards from the bottom.

SUMMARY OF THE INVENTION

The container closure of the present invention is a bottle cap having a fluid applicator such as a brush or dropper that fits over the bottle secured by a spring clip. The neck of the bottle ends in a seal seated on oil based paper, which is itself seated on a rubber or a plastic ring. A slight bulge just below the neck acts as a catch.

In use the cap has levers with protrusions that slide down over the bulge and "hook" into place, under the bulge. The cap opens only when pressed on both sides at the same time; otherwise the bottom of the spring clip is held in place by the bulge. By pressing both sides at once, the cap can slip over the bulge and off the bottle. The double press spring clip cap has the additional value of being child proof.

The liner of the bottle, (or possibly the bottle itself if desired) is in the shape of the letter V. The V shape means that when the bottle is upright, the fluid will collect in the bottom of the V and be accessible and usable until the last drop is consumed.

The embodiment shown in the sketch is of a woman's nail polish bottle. These bottles are particularly troublesome to their owners since they come with small brushes attached to the cap. In a conventional bottle, as the level of the nail polish falls, uses try to tilt the bottle so that the liquid will collect in a corner. But the brushes in the cap cannot be angled to reach the corners; they can only be inserted straight down. Under ordinary circumstances, the last of the liquid simply dries up along the flat bottom. The design presented here allows the last drops to be used.

DETAILED DESCRIPTION OF A PREFERRED EMBODIMENT

Figure 1:
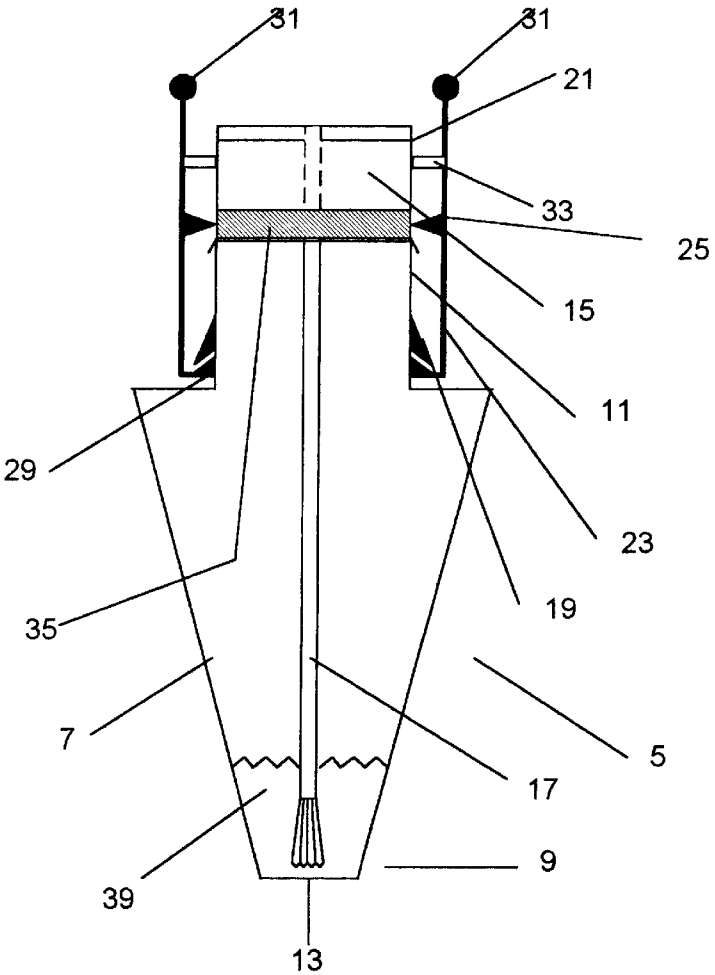
FIG. 1 is a cross-sectional view of the container having a tapered bottom in a closed position.
Figure 4:
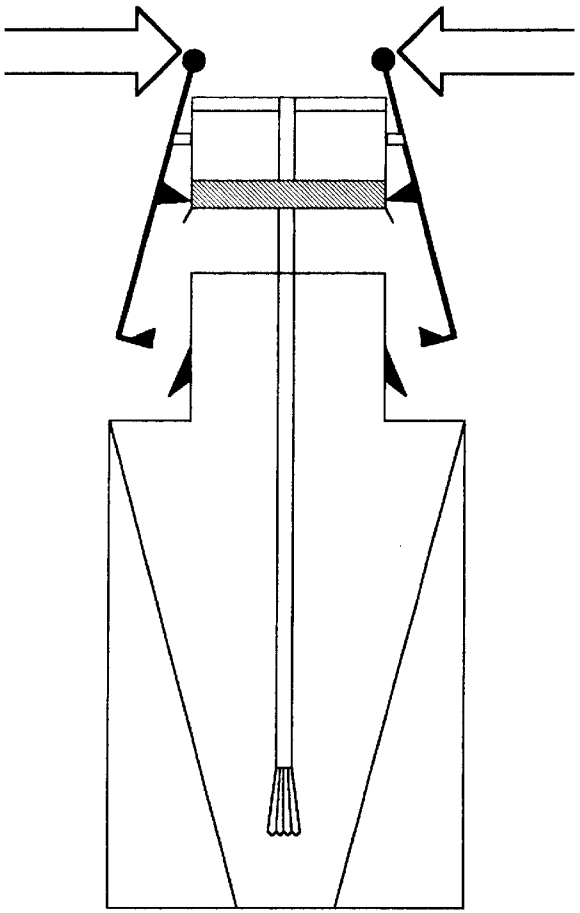
FIG. 4 is a cross-sectional view of the container, in an open position, with an inner lining which is tapered at its bottom.

As seen in its closed position in FIG. 1, a container 5 for fast drying liquids 39 is generally formed with a base element 7 and a cap, termed a closure element 15. The base element 7 comprises a top 11 and a tapered bottom 9. The closure element 15 comprises a cap 21 attached to which is a brush 17, which extends along the base's axis 13, from the base's top 11 to the base's tapered bottom 9. The brush has a width slightly less than or approximately equal to the cross-section of the base element at the tapered bottom thereof.

In a preferred embodiment, closure element 15 comprises a pair of lever arms 23 with inward facing protrusions 29, which engage a bulges 19 located on the base element 7 when the container 5 is in its closed position (see FIG. 1), and a seal 35, which rests on a ledge 37 within the cap 21. The bulges 19 could be in the form of a flange extending around the top 11 in such a position as to be engaged by the protrusions 29 of the lever arms 23.

Figure 2:
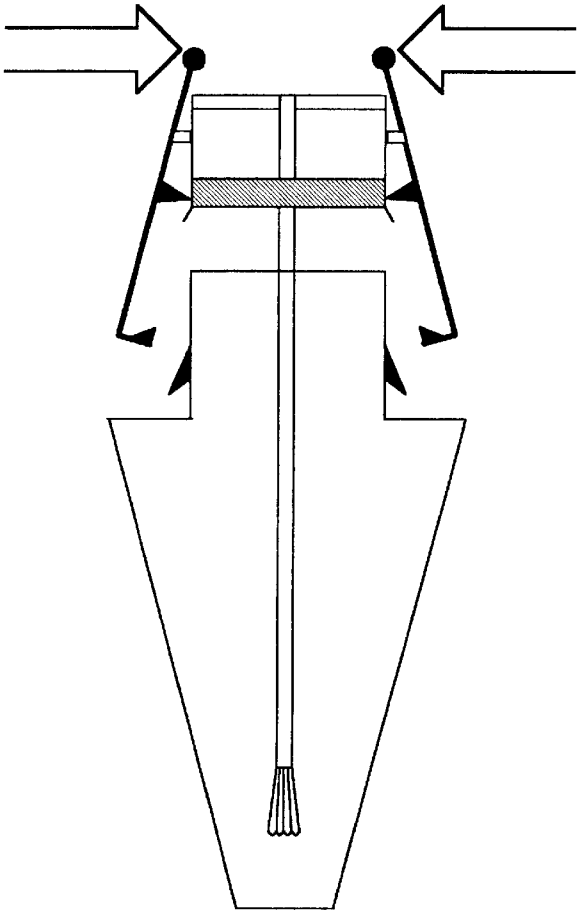
FIG. 2 is a cross-sectional view of the container having a tapered bottom in an open position.

The closure element 15 is easily removed from the base element 7 due to both the pivots 25, located between the lever arms 23 and the lower cross-section of the cap 21, and the elastic members 33, located between the lever arms 23 and the cap 21. As depicted in FIG. 2, by applying pressure at the pressure contact areas 31 of the lever arms 23, located above the pivots 25 and the elastic members 33, the lever arms 23 are deflected by the pivoting about the pivots 25 and the compression of the elastic members 33, causing the inward facing protrusions 29 to disengage from the bulges 19. The elastic members 33 could for example be springs, or rubber members, and may be located at points on the cap 21 or extend circumferentially about the cap 21. They may be attached to the lever or the cap or both. Alternatively the elastic members 33 could be replaced by a elastic members on or above the top of the cap, provided they restrain the motion of the lever arms 23.

Figure 3:
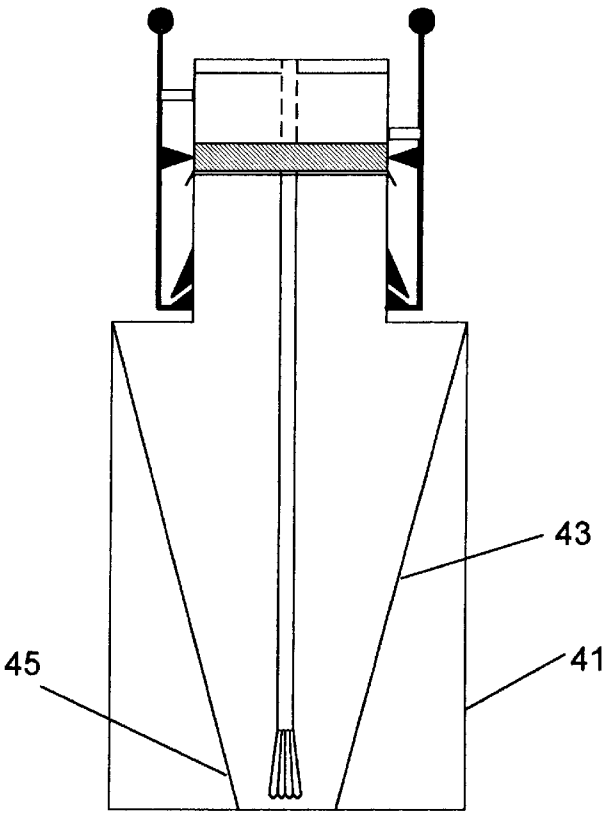
FIG. 3 is a cross-sectional view of the container, in a closed position, with an inner lining which is tapered at its bottom.

Turning now to FIG. 3, in an alternative embodiment to that shown in FIG. 1, the base element 7 itself does not have an externally tapered bottom 9. Instead, an inner lining 43 or an inner surface with a tapered bottom 45 is placed within the base element 7. While providing the same functionality as the embodiment in FIG. 1, the placement of the inner lining 43 within the base element 7 allows the base element 7 itself to be altered into various shapes and forms for aesthetic or mechanical stability purposes.

As will be appreciated, the tapered shape of container 5, will promote efficient use of fast drying liquids 39. A problem often associated with conventional containers which house fast drying liquids 39, such as women's nail polish or glue, is the difficulty involved in reaching the fast drying liquids 39 when most of the product is depleted, and only a small portion remains. The brushes or droppers attached to the caps of these conventional containers must be strenuously angled while attempting to reach the remnants of the fast drying liquids in the corners of these containers, and often this is not possible because of the large cap structure that is needed. Thus, this container 5 allows easy access to fast drying liquids 39 when only a small portion of product remains.

As another feature of the present invention, it avoids the problem of fast drying liquids 39 adhering to the lids of conventional containers. Fast drying liquids 39 often adhere to the lids of their containers, causing difficulty in lid removal. By simply applying pressure at the pressure contact areas 31, the closure element 15 can easily be removed from the base element 7.

Having described preferred embodiments of the invention with reference to the accompanying drawings, it will be appreciated that the present invention is not limited to that precise embodiment, and that various changes and modifications can be effected therein by one of ordinary skill in the art without departing from the spirit or the scope of the invention as defined in the appended claims.

What is claimed is:

1. A container for fast drying liquids comprising:

a container having
- a base element,
- a tapered bottom,
- a top,
- an axis,
- a closure element, said closure element comprising
  - a brush extending along said axis from the top of said base element to the tapered bottom thereof, wherein said base element further comprises
- protrusions extending radially outward away from the axis of said base element, said closure element comprises
- a cap integrally connected to said brush,
- a pair of lever arms on diametrically opposite sides of said cap, each lever arm comprising
  - a protrusion facing inward at a lower end of each lever arm,
  - a pressure contact area at an upper end of each lever arm extending above said cap,
- a pivot in contact with a cross-section of said cap,
- an elastic member intermediate of said pivot and said pressure contact area, said elastic member extending from said lever arm to said cap,
- a seal contacting a ledge within said cap,
- wherein said container has an open and closed position,
  - said closed position being one in which said protrusions facing inward engage said protrusions on said base element,
  - said open position being one in which said levers are deflected so that said protrusions facing inward and said protrusions on said base element are disengaged and said cap is raised from said base element.

2. A container according to claim 1, wherein said brush has a width approximating the cross-section of said base element at said tapered bottom.

3. A container for fast drying liquids comprising:

a container having
- a base element,
- a tapered bottom,
- a top,
- an axis,
- a closure element, said closure element comprising
  - a fluid applicator extending along said axis from the top of said base element to the tapered bottom thereof, wherein said base element further comprises
- protrusions extending radially outward away from the axis of said base element, said closure element comprises
- a cap integrally connected to said fluid applicator,
- a pair of lever arms on opposite sides of said cap, each lever arm comprising
  - a protrusion facing inward at a lower end of said lever arm,
  - a pressure contact area at an upper end of each lever arm extending above said cap,
- a pivot in contact with said cap,
- an elastic member intermediate of said pivot and said pressure contact area, said elastic member extending from said lever arm to said cap,
- a seal contacting a ledge within said cap,
- wherein said container has an open and closed position,
  - said closed position being one in which said protrusions facing inward engage said protrusions on said base element,
  - said open position being one in which said levers are deflected so that said protrusions facing inward and said protrusions on said base element are disengaged and said cap is raised from said base element.

4. A container for fast drying liquids comprising:

a base element, having a top and a bottom, an inner lining with a tapered bottom, an axis, a closure element, said closure element comprising
- a brush extending along said axis from the top of said base element to the bottom thereof, wherein said base element further comprises
- protrusions extending radially outward away from the axis of said base element, said closure element comprises
- a cap integrally connected to said brush,
- a pair of lever arms on diametrically opposite sides of said cap, each lever arm comprising
  - a protrusion facing inward at a lower end of each lever arm,
  - a pressure contact area at an upper end of each lever arm extending above said cap,
- a pivot in contact with a lower cross-section of said cap, an elastic member intermediate of said pivot and said pressure contact area, said elastic member extending from said lever arm to said cap, a seal contacting a ledge within said cap, wherein said container has an open and closed position, said closed position being one in which said protrusions facing inward engage said protrusions on said base element, said open position being one in which said levers are deflected so that said protrusions facing inward and said protrusions on said base element are disengaged and said cap is raised from said base element.

5. A container according to claim 4, wherein said brush has a width slightly less than the cross-section of said inner lining at said tapered bottom.

6. A container for fast drying liquids comprising:

a base element, having a top and a bottom, an inner lining with a tapered bottom, an axis, a closure element, said closure element comprising a fluid applicator extending along said axis from the top of said base element to the bottom thereof, wherein said base element further comprises protrusions extending radially outward away from the axis of said base element, said closure element comprising a cap integrally connected to said fluid applicator, lever arms on diametrically opposite sides of said cap, each lever arm comprising a pivot in contact with a lower cross-section of said cap, a protrusion facing inward at a lower end of each lever arm, a pressure contact area at an upper end of each lever arm extending above said cap, an elastic member intermediate of said pivot and said pressure contact area, said elastic member extending from said lever arm to said cap, a seal contacting a ledge within said cap, wherein said container has an open and closed position, said closed position being one in which said protrusions facing inward engage said protrusions on said base element, said open position being one in which said levers are deflected so that said protrusions facing inward and said protrusions on said base element are disengaged and said cap is raised from said base element.

7. A container having a base and a closure element, wherein said base element comprises protrusions extending radially outward away from said base element, said closure element comprises a cap, a pair of lever arms on opposite sides of said cap, each lever arm comprising a protrusion facing inward at a lower end of said lever arm, a pressure contact area at an upper end of each lever arm extending above said cap, a pivot in contact with said cap, an elastic member intermediate of said pivot and said pressure contact area, said elastic member extending from said lever arm to said cap, a seal contacting a ledge within said cap, wherein said container has an open and closed position, said closed position being one in which said protrusions facing inward engage said protrusions on said base element, said open position being one in which said levers are deflected to compress said elastic member so that said protrusions facing inward and said protrusions on said base element are disengaged and said cap is raised from said base element.

* * * * *